US005904251A

United States Patent [19]

Ogata et al.

[11] Patent Number: 5,904,251

[45] Date of Patent: May 18, 1999

[54] CONTAINER FOR FLAT PANEL

[75] Inventors: Masamiki Ogata; Kenji Iwamoto; Kazuo Fujimoto, all of Tokyo, Japan

[73] Assignee: Zeon Kasei Co. , Ltd., Tokyo, Japan

[21] Appl. No.: 09/075,524

[22] Filed: May 11, 1998

[30] Foreign Application Priority Data

May 13, 1997 [JP] Japan ..... 9-137602

[51] Int. Cl.[6] ..... B65D 85/86

[52] U.S. Cl. ..... 206/722; 206/386; 206/453; 206/454; 206/587

[58] Field of Search ..... 206/386, 449, 206/451, 453, 454, 587, 701, 706, 707, 722, 724

[56] References Cited

U.S. PATENT DOCUMENTS 4,815,601 3/1989 Peterson et al. ..... 206/454

5,423,422 6/1995 Boire et al. ..... 206/454

5,588,531 12/1996 Yoshida et al. ..... 206/454

5,727,685 3/1998 Laganza et al. ..... 206/454

*Primary Examiner*—Jim Foster

*Attorney, Agent, or Firm*—Armstrong, Westerman, Hattori, McLeland & Naughton

[57] ABSTRACT

A container 2 for flat panels comprising: a lower end holding shock absorber member 30 resiliently holding a lower end of said flat panel 34 contained in the container 2; an upper end holding shock absorber member 50 resiliently holding an upper end of the flat panel; a side shock absorber member 42 comprised of a resilient member and provided with parallel guide grooves 44 for slidably guiding a side end of the flat panel 34; and a side spacer 40 for attaching said side shock absorber member 42 on an inner wall surface of said container 2 so that a distance between said side shock absorber member 42 and said inner wall is adjustable. The lower end holding shock absorber member 30 is designed to be adjustable in height with a bottom spacer 35.

8 Claims, 7 Drawing Sheets

CONTAINER FOR FLAT PANEL

BACKGROUND OF THE INVENTION

1. Field of the Invention

The present invention relates to a container for flat panels and, more particularly, to a container for taking custody of or transporting flat panels used for parts of flat display devices and the like in good condition without being damaged or destroyed.

2. Description of the Related Art

In flat display devices such as liquid crystal display devices and plasma display devices, electrodes or separating walls are formed on glass substrates by means of screen printing and the like, and the glass substrates are transported to another factory to assemble or re-process them during a process of producing these substrates. In this case, a container is required for taking custody of and transporting the glass substrates without destroying them or contaminating the surfaces.

The conventional container, however, did not permit transporting flat panels such as glass substrates used for flat display devices without destroying the panels and contaminating the surfaces thereof.

Further, since an opening portion of the conventional container is formed on the top portion of the container, working operation is required to take the flat panels in and out from the top portion of the container. A working operation of such kind, that does not destroy the flat panels, is difficult.

SUMMARY OF THE INVENTION

In view of the foregoing circumstance, an object of the present invention is to provide a container for flat panels which is able to take custody of or transport a plurality of flat panels such as glass substrates used for flat display devices without destroying the flat panels and contaminating the surfaces thereof.

To achieve the above-mentioned object, a container for a flat panel of the present invention comprises:

- a lower end holding shock absorber member resiliently holding a lower end of said flat panel contained in the said container;
- an upper end holding shock absorber member resiliently holding an upper end of said flat panel;
- a side shock absorber member comprised of a resilient member and provided with parallel guide grooves for slidably guiding a side end of said flat panel; and
- a side spacer for attaching said side shock absorber member on an inner wall surface of said container so that a distance between said side shock absorber member and said inner wall is adjustable.

Preferably, the container is provided on a bottom portion thereof with a palette into which a nail portion of a forklift can be inserted, and the container is comprised so that one of the outer wall surfaces of said container parallel to said flat panel contained in the container becomes a bottom support surface when said container is toppled over on its side.

The lower end holding shock absorber member and upper end holding shock absorber member are not restricted, however, are comprised for example of a plate-shaped resilient member having elasticity. Preferably, the lower end holding shock absorber member is designed to be adjustable in height from a bottom surface of the container with a bottom spacer.

Further, the upper end holding shock absorber member may be comprised of a belt-shaped resilient portion having a U-shaped cross-section. A pair of fitting rods extending along the longitudinal direction thereof may be attached at both sides of both ends in the longitudinal direction thereof, and each end of each fitting rod may be removably attached in an engagement groove of an adapter attached in the container.

Further, the upper end holding shock absorber member may be formed to have belt-shaped portions and support portions alternate continuously along one direction. The support portions hold the fitting rods, respectively.

Further, the lower end holding shock absorber member may have a rope-shaped resilient member attached within a bottom of an attachment groove extending substantially perpendicular to a lower end holding groove formed on a lower end holding block.

In the container for a flat panel of the present invention, the flat panels such as glass substrates contained in the container are held at each upper end of the flat panel by the upper end holding shock absorber member and are held at each lower end of the flat panel by the lower end holding shock absorber member. Namely, a plurality of the flat panels are held so as to be sandwiched in a vertical direction. Accordingly, the flat panels held resiliently in a vertical direction are not destroyed, even if vibration is exerted on the container. Further, since there are spaces between the flat panels, the surfaces of the flat panels are not contaminated. Especially, when an inert gas such as nitrogen gas is introduced into the space between the flat panels, it may be possible to effectively protect the panels from adhesion of dust or particles on the surfaces of the flat panels.

Further, when the upper end holding shock absorber member is comprised of the belt-shaped member having a substantially U-shaped cross-section, the upper end portion of the flat panel is covered by the upper end holding shock absorber member so that the upper end of the flat panel is secured and a strong construction capable of bearing not only vertical vibrations but also horizontal and transverse vibrations is obtained.

Further, in accordance with the present invention, an attaching distance between the inner wall surface of the container and the side shock absorber member provided with parallel guide grooves for slidably guiding the side end of the flat panel can be adjusted by replacing the side spacer. Accordingly, only by preparing a variety of side spacers and replacing them, it is possible to contain different flat panels having different horizontal widths in the same container. Namely, by only replacing the side spacers, it is possible to take custody of or transport the different flat plates such as glass plates corresponding to the different screen sizes in the same container. When a vertical height of the flat panels to be contained are different, the bottom spacer may be replaced.

Further, in accordance with the present invention, since the container is provided on a bottom portion thereof with a palette into which a nail portion of a forklift is inserted, the container can be easily transported. Further, since the container is comprised so that one of the outer wall surfaces parallel to said flat panel contained in the container becomes a bottom support surface when said container is toppled over on its side, operation of taking the flat panels in and out from the container becomes very easy. Namely, when the container is toppled over on its side, the top opening portion of the container is turned sideways and each of the flat panels disposed parallel at a predetermined distance in the vertical direction can be easily taken out from the container after opening the top opening portion. A robot hand and the like may be used when the flat panels are taken in and out from the container. Note that the flat panels do not contact each other when the container is toppled over on its side, because the sides of the flat panels are supported by the side shock absorber member in the container.

BRIEF DESCRIPTION OF THE DRAWINGS

Other objects and features of the present invention will be described in detail with reference to the accompanying drawings, in which.

DESCRIPTION OF THE PREFERRED EMBODIMENTS

Figure 1:
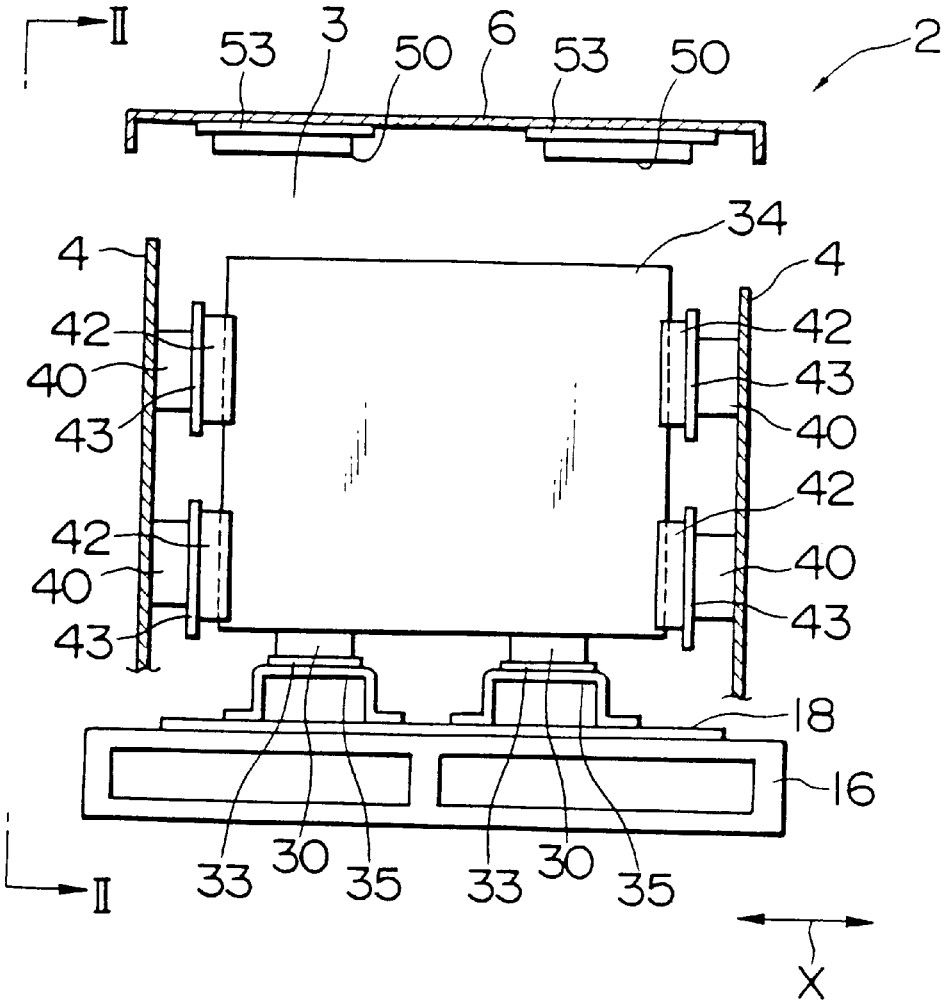
FIG. 1 is a schematic decomposed cross-sectional view of a container which is an embodiment of the present invention.
Figure 2:
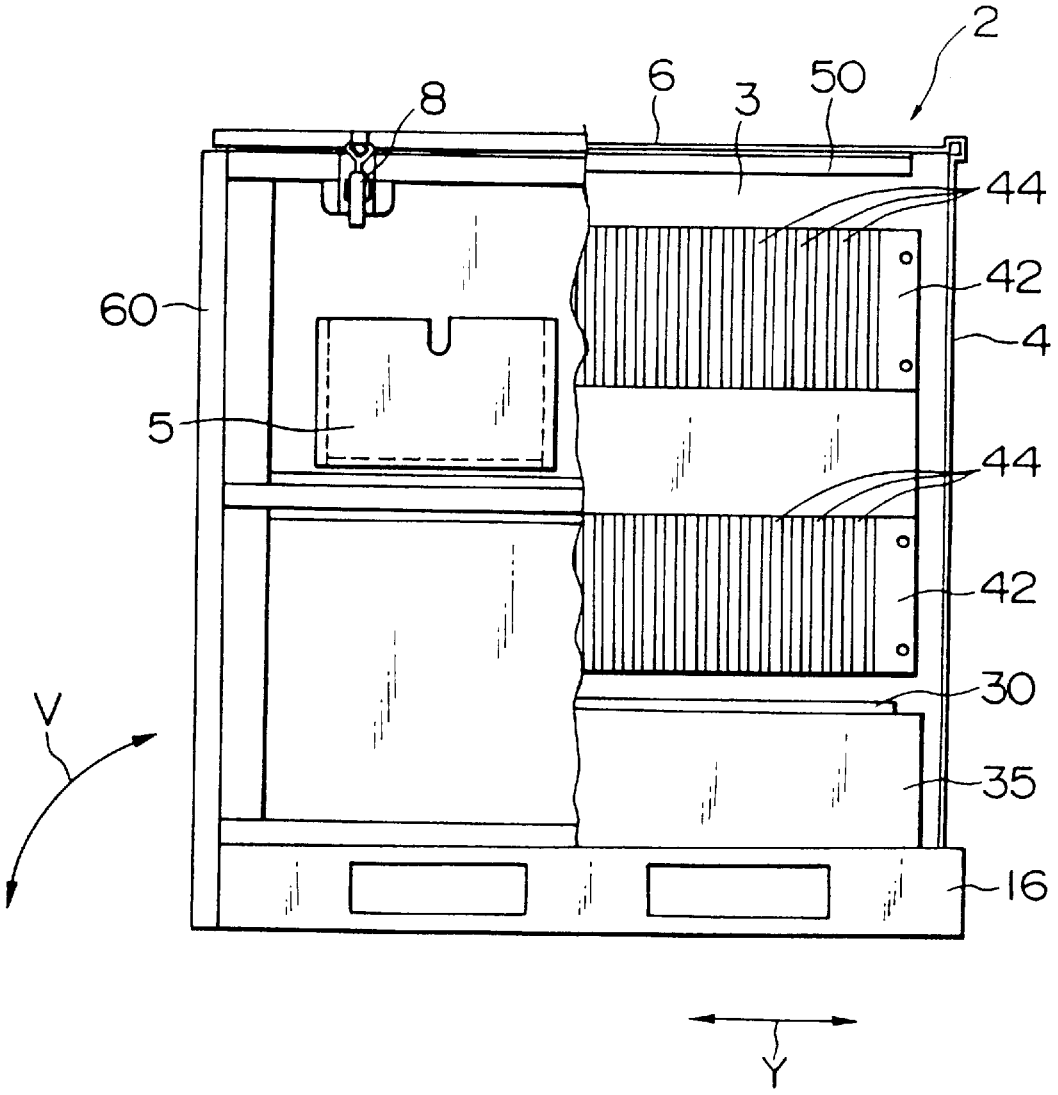
FIG. 2 is a partially broken front view along the II—II line shown in FIG. 1.

As shown in FIGS. 1 and 2, the container 2 for a flat panel of the present embodiment comprises a rectangle shaped main container body 4 having an opening portion 3 at the upper end thereof. The main container body 4 is comprised of a complex material of synthetic resin and metal such as aluminum.

A lid member 6 is removably attached on the opening portion 3 of the main container body 4. The lid member 6 is comprised of a material similar to that of the main container body 4. One-touch control type lock members 8 are attached on mutually opposite side walls of the main container body 4 near the opening portion. The lock members 8 make it possible to fix the lid member 6 on the opening portion of the main container body 4 and to seal off the inside. When opening the lid member 6, the lock members 8 are operated, so that the lid member 6 is able to be removed with one touch control.

One side wall of the main container body 4 is provided with a sight glass for viewing the inside of the container, through which the inside of the container is able to be viewed for confirmation of the contents. In this embodiment, as shown in FIG. 2, card insertion portion 5 is formed on the side wall in which a card showing information and the like regarding the flat panels contained in the container may be inserted.

A pallet 16 is attached to the bottom of the container 4. The pallet 4 is designed so that the nail portions of a forklift can be inserted to move the container by the forklift.

In the main container body 4, a drying agent box (not shown) may be attached and drying agents such as a silica gel may be incorporated therein in order to remove moisture in the container.

In the present embodiment, as shown in FIG. 1, a bottom plate 18 is attached to the palette 16 and bottom spacers 35 are removably connected thereon by means of bolts or screws. Substrates 33 provided with plate-shaped lower end holding shock absorber members 30 are removably attached on the bottom spacers 35 by means of bolts or screws. In this embodiment, the lower end holding shock absorber members 30 are comprised of elastic materials. Examples of the materials include diene rubbers such as styrene-butadiene rubber (SBR), butadiene rubber (BR), isoprene rubber (IP), acrylonitrile-butadiene rubber (NBR) and chloroprene rubber (CR), butyl rubber (IIR), ethylene-propylene-diene terpolymer rubber (EPDM), acrylic rubber, chlorosulfonated polyethylene rubber, fluororubber, urethane rubber, polysulfide rubber, foam of any of the rubbers mentioned above and foam of urethane or nylon.

Each substrate 33 is comprised of a complex plate including an aluminum plate and is adhered to the lower end holding shock absorber member 30. The lower ends of the glass substrates 34 as flat panels contact the lower end holding shock absorber members 30 to be resiliently supported.

Each bottom spacer 35 is comprised of an angle member and is designed to be removably attached to the bottom plate 18 and the substrate 33 in this embodiment. A plurality of spacers 35 having different heights are prepared in advance, suitable spacers 35 among them are selected in accordance with the vertical width of the glass substrates 34 as flat panels contained in the container 2.

Note that upper end holding shock absorber members 50 comprised of elastic materials similar to the lower end holding shock absorber members 30 are attached on an inner surface of the lid member 6. Each upper end holding shock absorber member 50 is adhered to a substrate 53 similar to the substrate 33 and the substrate 53 is attached to the inner surface of the lid member 6 by means of screws and the like. Upper ends of the glass substrates 34 contact the upper end holding shock absorber members 50 when the lid member 6 is closed, so that the glass substrates 34 are supported resiliently in a sandwich manner vertically between the shock absorber members 50 and 30 when the selected bottom spacers 35 have a suitable height.

Figure 3:
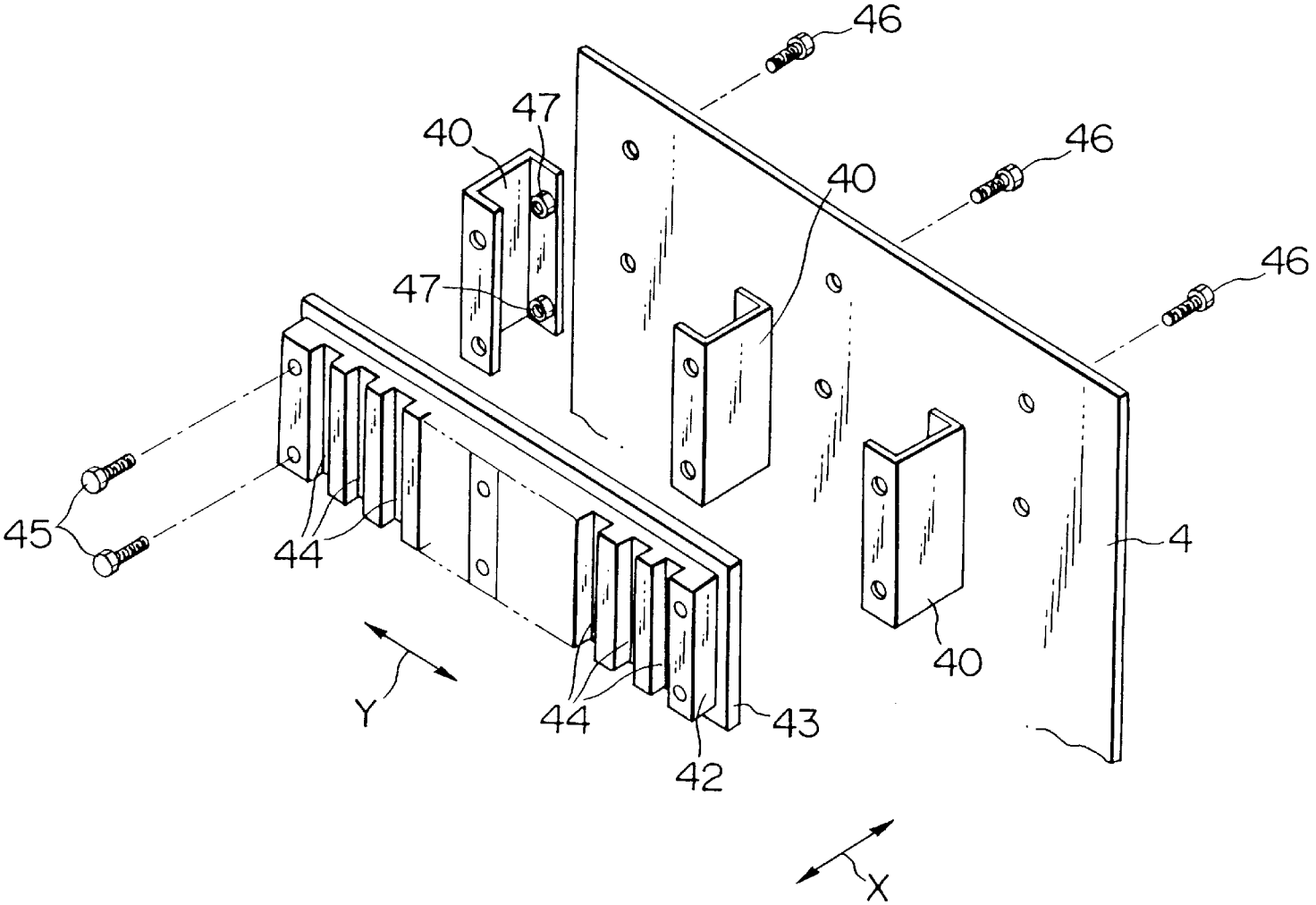
FIG. 3 is a decomposed partial perspective view showing an attaching condition of a side shock absorber member.

As shown in FIGS. 1 to 3, side shock absorber members 42 adhered to the substrates 43 are attached via side spacers 40 to the inside of side walls located at both ends in the direction X of the container 4. Each side shock absorber member 42 is comprised of an elastic material similar to the above-mentioned lower end holding shock absorber member 30 and upper end holding shock absorber member 50.

Figure 4:
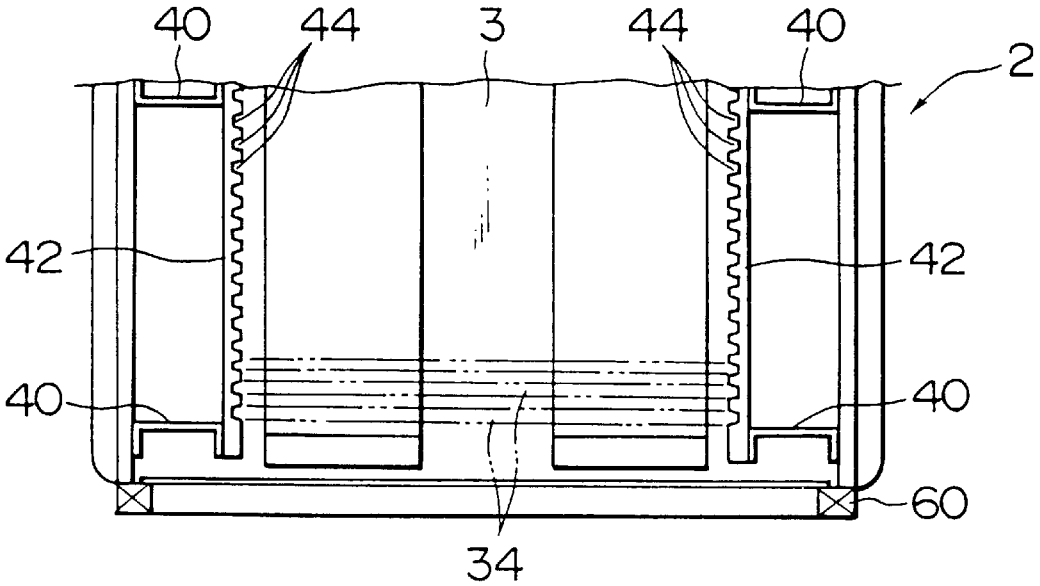
FIG. 4 is a partial view from the opening portion of the container toppled over on its side.

Each side shock absorber member 42 is provided with guide grooves 44 extending in parallel in a vertical direction at predetermined distances along the Y direction. As shown in FIGS. 1 and 4, both side ends of the glass substrate 34 are slidably inserted into these guide grooves 34. Note that the holding of the glass substrate 34 is secured by both of the above-mentioned lower end holding shock absorber members 30 and the upper end holding shock absorber members 50. The guide grooves 44 of the side shock absorber member 42 only play a guiding role. In these foregoing views, each groove width of the guide grooves 44 is made larger than each thickness of the glass substrate 34 by preferably 5–40%, more preferably 10–25%.

Each substrate 43 to which the side end holding shock absorber member 42 is adhered, is removably attached to the spacers 40 by means of bolts 45 as shown in FIG. 3. The spacers 40 are removably attached to a side wall of the main container body 4 by means of bolts 46. Nuts 47 are connected to insides of the spacer 40 so as to be screwed with the bolts 45 and 46.

In this embodiment, the side shock absorber members 42 are attached at two positions in the vertical direction to each single side plate of the container 2 as shown in FIGS. 1 and 2.

Further, in this embodiment, as shown in FIG. 2, the container 2 comprises a frame 60 disposed at an outer wall of the container in parallel to the glass substrates 34 contained in the container 2 and defining a flat surface which becomes a bottom supporting surface when the container is toppled over on its side along the direction of arrow V. In accordance with this construction, the frame 60 acts as a supporting bottom surface, as shown in FIG. 4, and the opening portion 3 of the container 2 faces front when the container 2 is toppled over along the direction of arrow V. In addition, the glass substrates 34 contained in the container 2 are supported between the side shock absorber members 42,42 and disposed in parallel at predetermined distances in the vertical direction without contacting each other. Accordingly, each of the glass substrates 34 can be easily taken out from the container one by one. A robot hand and the like may be used when the glass substrates 34 are put in and taken out from the container.

In the container 2 for flat panels of the present embodiment, the glass substrates 34 contained in the container 2 are held at each upper end of the glass substrates by the upper end holding shock absorber members 50 and are held at each lower end of the glass substrates 34 by the lower end holding shock absorber members 30 as shown in FIG. 1. Namely, a plurality of the glass substrates 34 are held so as to be sandwiched between the shock absorber members in a vertical direction. Accordingly, the glass substrates 34 are resiliently held vertically between the top and bottom ends and are not destroyed, even if vibration is exerted on the container 2. Further, since there are spaces between the glass substrates 34, the surfaces of the glass substrates 34 are not contaminated. Especially, when the container is designed so that nitrogen gas can be introduced into the spaces between the glass substrates, it may be possible to effectively protect against adhesion of dust or particles on the surfaces of the glass substrates 34.

Note that the present invention is not restricted to the above-mentioned embodiments and may be modified in a variety of modes within the spirit of the present invention.

Figure 5:
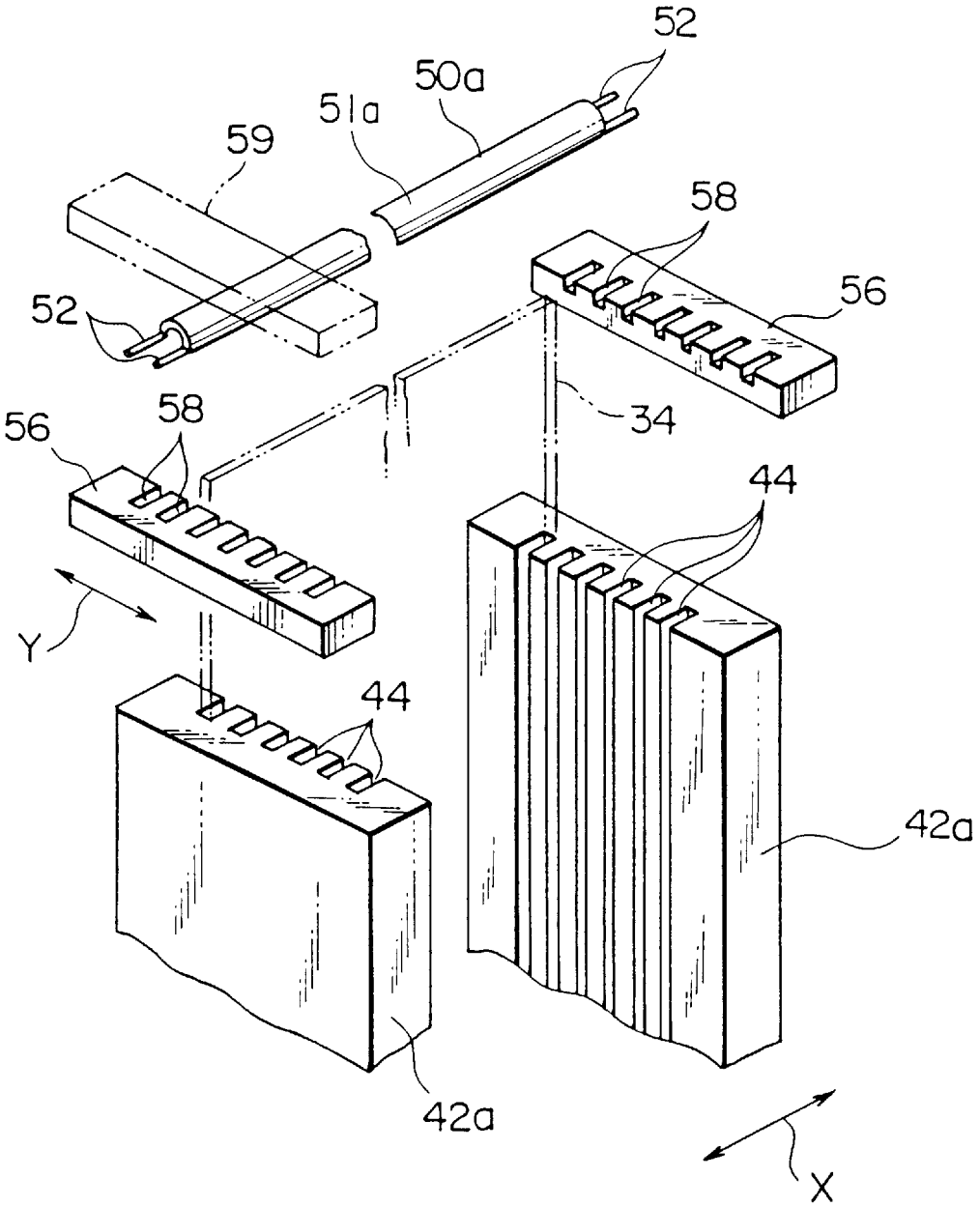
FIG. 5 is a decomposed perspective view of an upper end holding shock absorber member of another embodiment of the present invention.

For example, upper end holding shock absorber members 50*a* shown in FIGS. 5 and 6 may be used. The upper end holding shock absorber member 50*a* shown in FIGS. 5 and 6 is comprised of a belt-shaped resilient portion 51*a* having a U-shaped cross-section and is, for example, comprised of a material similar to the upper end holding shock absorber member 50 shown in FIG. 1. The shock absorber member 50*a* is preferably comprised of a sponge. The surface of the sponge is preferably covered with a sheet for preventing static electricity.

Figure 6A:
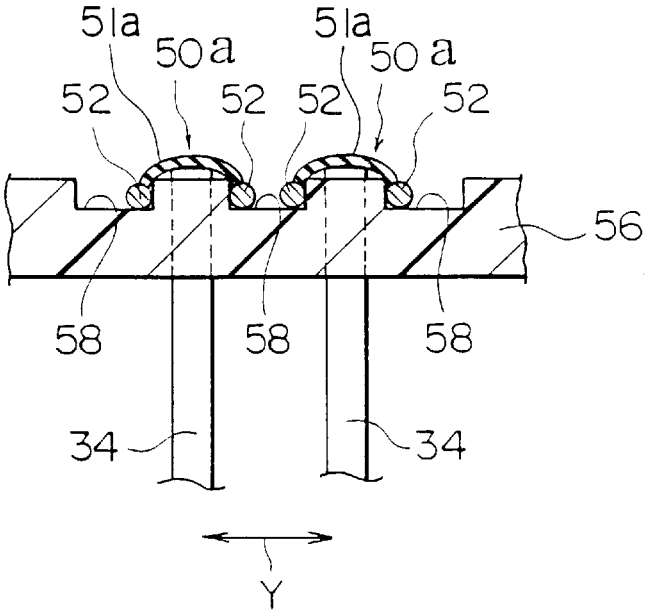
FIGS. 6A and 6B are schematic views showing an important portion of the upper end holding shock absorber member.

Fitting rods 52 holding the upper end holding shock absorber member 50*a* at both sides along the longitudinal direction are, for example, comprised of stainless steel and are designed to protrude from both ends of the shock absorber member 50*a* in a longitudinal direction. As shown in FIG. 6A, both ends of the fitting rods 52 are able to be engaged in the groove wall portions of engagement grooves 58 of the adapters 56. A stopper member 59 shown in FIG. 5 is removably mounted on the adapter 56 respectively so that the fitting rods 52 are fixed in the engagement grooves 58 of the adapter 56 and consequently each upper end holding shock absorber member 50*a* holds and covers the upper end of the glass substrates 34 respectively along the longitudinal direction thereof as shown in FIG. 6A.

Figure 6B:
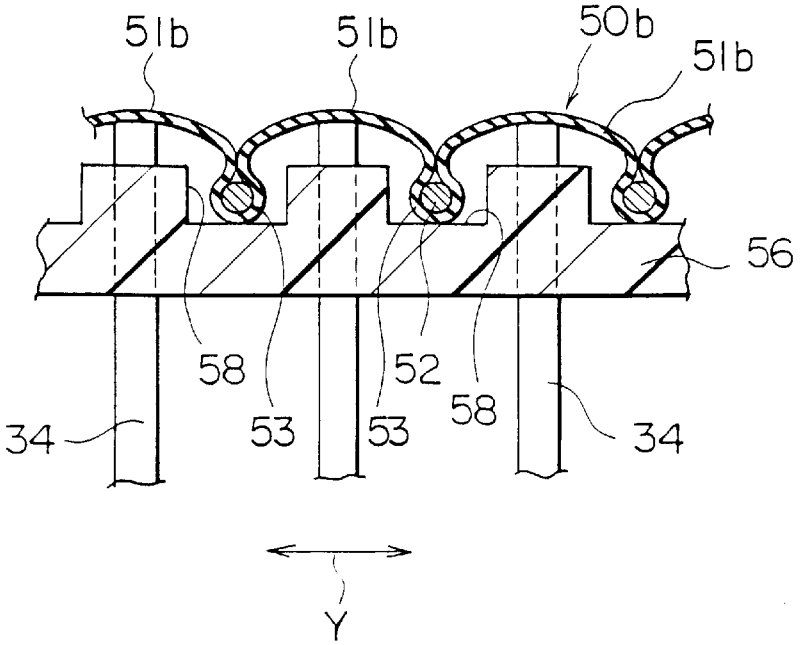

Alternatively, as shown in FIG. 6*b*, the upper end holding shock absorber member of the present invention may be an upper end holding shock absorber member 50*b* on which belt-shaped resilient portions 51*b* having a U-shaped cross-section are formed continuously from sheet material. The sheet material is comprised of an elastic sheet made from the same material as that of the belt-shaped resilient portion 51*a*. The sheet material is processed by means of molding, heating and/or pressing to form belt-shaped portions 51*b* and support portions 53 alternate continuously along the Y direction. The support portions 53 hold the fitting rods 52 respectively. The fitting rods 52 of the resilient member 50*b* which are arranged in predetermined distances may be fixed in the engagement grooves 58 of the adapter 56.

In this embodiment, since the upper end holding shock absorber member 50*a* or 50*b* has the belt-shaped portion 51*a* or 51*b* having a substantially U-shaped cross-section, the upper end portion of the glass substrate 34 is covered by the upper end holding shock absorber member 50*a* or 50*b*, so that the holding of the upper end portion of the glass substrate 34 is secured and a strong construction is provided that is capable of bearing not only vertical vibrations but also horizontal and transverse vibrations.

Further, the construction of the lower end holding shock absorber member of the present invention is also not restricted to that of the above-mentioned embodiment and may be a construction shown in FIG. 7 for example.

Figure 7A:
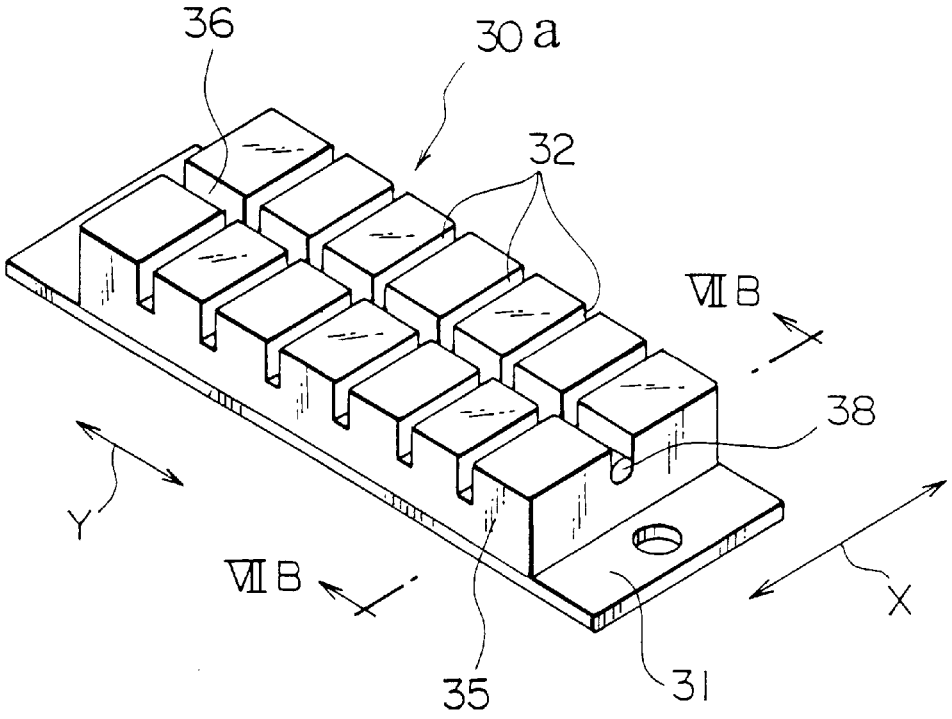
FIG. 7A is a perspective view of a lower end holding shock absorber member.
Figure 7B:
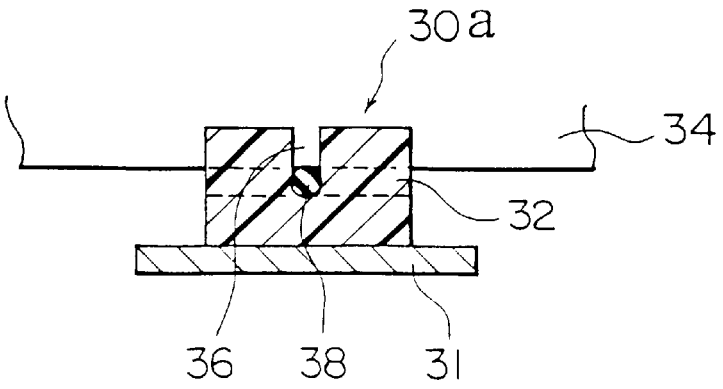
FIG. 7B is a partial cross-section along the VII B—VII B line shown in the FIG. 7A.

As shown in FIGS. 7A and 7B, in this embodiment, a lower end holding shock absorber members 30*a* are disposed inside the bottom wall of the main container body 4 in predetermined distances along the direction X of the bottom wall instead of the lower end holding shock absorber members 30 and substrates 33 shown in FIG. 1. Each lower end holding shock absorber member 30*a* has a lower end holding block 35. The bottom surface of the lower end holding block 35 is adhered to an attaching plate 31. The attaching plate 31 is comprised of a metal plate made of stainless steel and the like. The plate 31 is attached inside the bottom wall of the main container body 4 by means of bolts, screws and the like. The lower end holding block 35 is comprised of, for example, a resin foam.

On the upper surface of the lower end holding block 35, a plurality of lower end holding grooves 32 are formed substantially parallel along the X direction at predetermined distances along the Y direction (which is perpendicular to the X direction). Lower ends of the glass substrates are inserted respectively in the lower end holding grooves 32 as shown in FIG. 7B. Namely, the number of the lower end holding grooves 32 formed thereon corresponds to the number of the glass substrates capable of being contained in the container 2.

As shown in FIGS. 7A and 7B, an attaching groove 36 extending along the Y direction substantially perpendicular to the lower end holding grooves 32 is formed across the center of the lower end holding grooves 32. The depths of these lower end holding grooves 32 and the attaching groove 36 are substantially the same and are preferably 10–15 mm, more preferably 12–13 mm. A rope-shaped resilient member 38 is inserted into the attaching groove 36. As shown in FIG. 7B, the lower ends of the glass substrates 34 are inserted into the lower end holding grooves 32 and are placed on the rope-shaped resilient member 38 and are supported by the resilient force thereof. The rope-shaped resilient member 38 is, for example, comprised of rubber.

What is claimed is:

1. A container for a flat panel, comprising:

a lower end holding shock absorber member resiliently holding a lower end of said flat panel contained in the said container;

an upper end holding shock absorber member resiliently holding an upper end of said flat panel;

a side shock absorber member comprised of a resilient member and provided with parallel guide grooves for slidably guiding a side end of said flat panel; and a side spacer for attaching said side shock absorber member on an inner wall surface of said container so that a distance between said side shock absorber member and said inner wall is adjustable.

2. The container for a flat panel as set forth in claim 1, wherein said container is provided on a bottom portion thereof with a palette into which a nail portion of a forklift can be inserted, and said container is comprised so that one of outer wall surfaces of said container parallel to said flat panel contained in said container becomes a bottom support surface when said container is toppled over on its side.

3. The container for a flat panel as set forth in claim 1, wherein said container comprises a frame disposed at an outer wall of said container in parallel to said flat panel contained in said container and defining a flat surface which becomes a bottom supporting surface when the container is toppled over on its side.

4. The container for a flat panel as set forth in claim 1, wherein said lower end holding shock absorber member and upper end holding shock absorber member are comprised of a plate-shaped resilient member having elasticity.

5. The container for a flat panel as set forth in claim 1, wherein said lower end holding shock absorber member is designed to be adjustable in height from a bottom surface of said container with a bottom spacer.

6. The container for a flat panel as set forth in claim 1, wherein said upper end holding shock absorber member comprises a belt-shaped resilient portion having a U-shaped cross-section, a pair of fitting rods extending along a longitudinal direction thereof may be attached at both sides of both ends in the longitudinal direction thereof, and each end of each fitting rod is removably attached in an engagement groove of an adapter attached in the container.

7. The container for a flat panel as set forth in claim 1, wherein said upper end holding shock absorber member is formed to have belt-shaped portions and support portions alternate continuously along one direction and said support portions hold fitting rods, respectively.

8. The container for a flat panel as set forth in claim 1, wherein said lower end holding shock absorber member has a rope-shaped resilient member attached within a bottom of an attachment groove extending substantially perpendicular to a lower end holding groove formed on a lower end holding block.

* * * * *